US008669837B2

(12) United States Patent
Gerster et al.

(10) Patent No.: US 8,669,837 B2
(45) Date of Patent: Mar. 11, 2014

(54) LAMINATE STACK COMPRISING INDIVIDUAL SOFT MAGNETIC SHEETS, ELECTROMAGNETIC ACTUATOR, PROCESS FOR THEIR MANUFACTURE AND USE OF A SOFT MAGNETIC LAMINATE STACK

(75) Inventors: Joachim Gerster, Alzenau (DE); Herbert Hoehn, Hanau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 561 days.

(21) Appl. No.: 12/869,243

(22) Filed: Aug. 26, 2010

(65) Prior Publication Data

US 2011/0050376 A1 Mar. 3, 2011
US 2012/0038439 A9 Feb. 16, 2012

(30) Foreign Application Priority Data

Aug. 27, 2009 (DE) ..... 10 2009 038 730

(51) Int. Cl.
*H01F 3/00* (2006.01)
*H01F 7/08* (2006.01)

(52) U.S. Cl.
USPC ..... 335/281; 335/297

(58) Field of Classification Search
USPC ..... 335/281, 297
See application file for complete search history.

(56) References Cited

U.S. PATENT DOCUMENTS

| | | | | |
|---|---|---|---|---|
| 2,498,702 | A * | 2/1950 | Nahman | 335/281 |
| 3,577,107 | A * | 5/1971 | Widl et al. | 335/248 |
| 5,138,393 | A * | 8/1992 | Okamura et al. | 335/297 |
| 6,118,366 | A * | 9/2000 | Bulgatz et al. | 336/234 |
| 6,380,832 | B2 * | 4/2002 | Oyama et al. | 335/281 |
| 6,651,913 | B1 | 11/2003 | Greif | |
| 6,688,578 | B1 | 2/2004 | Nussio et al. | |
| 2007/0175436 | A1 | 8/2007 | Grundl et al. | |
| 2008/0092854 | A1 | 4/2008 | Grundl et al. | |
| 2010/0219919 | A1 * | 9/2010 | Vannier et al. | 335/281 |

FOREIGN PATENT DOCUMENTS

| | | |
|---|---|---|
| DE | 502063 | 7/1930 |
| DE | 1740491 | 2/1957 |
| DE | 1564643 | 1/1970 |
| DE | 3500530 A1 | 7/1986 |
| DE | 19537362 B4 | 4/1996 |
| DE | 10005182 A1 | 8/2001 |
| DE | 10319285 B2 | 9/2004 |
| DE | 10394029 T5 | 12/2005 |
| DE | 102004032229 B3 | 1/2006 |

(Continued)

OTHER PUBLICATIONS

Office Action dated Apr. 22, 2010 for German Patent Application No. 10 2009 038 730.7-21 and English translation of the same.

(Continued)

*Primary Examiner* — Mohamad Musleh
(74) *Attorney, Agent, or Firm* — Dickinson Wright LLP

(57) ABSTRACT

A laminate stack having individual soft magnetic sheets. The individual sheets are involutely curved in the laminate stack. Each individual sheet has a first long side, a second long side opposite the first long side, a first short side and a second short side opposite the first short side. The first long side has a recess, said recess being rectangular and equidistant from the first short side, the second short side and the second long side when the individual sheet is in its uncurved state.

76 Claims, 5 Drawing Sheets

(56) References Cited

FOREIGN PATENT DOCUMENTS

| | | | | |
|---|---|---|---|---|
| DE | 102006055088 | A1 | | 6/2008 |
| DE | 102006055088 | B4 | | 12/2008 |
| EP | 138408 | A2 | * | 4/1985 |
| EP | 0 795 881 | B1 | | 6/1999 |
| GB | 2105522 | A | * | 3/1983 |
| JP | 4-365305 | | | 12/1992 |
| JP | 6-176921 | | | 6/1994 |
| JP | 10-308309 | | | 11/1998 |
| JP | 10-335138 | | | 12/1998 |
| JP | 11-67532 | | | 3/1999 |
| JP | 2002-343626 | | | 11/2002 |

OTHER PUBLICATIONS

Combined Search and Examination Report dated Dec. 10, 2010 for Great Britain Application No. 1014062.2.

* cited by examiner

LAMINATE STACK COMPRISING INDIVIDUAL SOFT MAGNETIC SHEETS, ELECTROMAGNETIC ACTUATOR, PROCESS FOR THEIR MANUFACTURE AND USE OF A SOFT MAGNETIC LAMINATE STACK

BACKGROUND

1. Field

Disclosed herein is a laminate stack comprising individual soft magnetic sheets, an electromagnetic actuator for controlling a quantity of fuel to be fed into an internal combustion engine for example, and a process for their manufacture.

2. Description of Related Art

An electromagnetic actuator comprises a valve seat with a fitting valve body, it being possible to move the valve body by means of a magnetic field acting on a magnet armature connected to the valve body. In this arrangement the magnetic field is built up by passing a current through a coil, the magnetic flux penetrating the magnet armature with a time delay.

Short switching times of less than 40 μs to 100 μs are desirable, particularly in electromagnetic actuators used as injection valves. In order to achieve short valve switching times, the time delay between the passing of the current through the coil and the build up of the magnetic field in the magnet armature should be as short as possible. An important factor limiting the lower end of the time delay range is the occurrence of eddy currents induced in the electrically conductive bodies of the magnet armature by the time change in the magnetic field.

An injection valve in which eddy currents generated in pole bodies between neighbouring coils cancel one another out by alternately passing current through said coils is described in DE 100 05 182 A1. The disadvantages of this arrangement are that this cancelling out of eddy currents can only be achieved locally and that the magnetic flux is also cancelled out. However, losses due to eddy currents remain high and prevent fast switching times. In addition, the constraints placed on the geometry of the coils and pole bodies in achieving maximum cancelling out of the eddy currents severely limit the design of the injection valve.

A further approach to reducing eddy currents is described in DE 103 19 285 B3 which discloses an injection valve which has radially running slits in both the magnet armature and the magnet core, it being possible for the magnet core to be made of stacked, slit iron sheets or alternatively of iron rings stacked concentrically one inside the other or in the manner of a toroidal core.

However, this injection valve has several disadvantages. Almost no magnetic flux passes through the slit-shaped air gaps and the conductor surface through which the magnetic flux passes is therefore lost and the valve is able to withstand only short opening and closing forces. In such arrangements, moreover, the flux is required to flow parallel to the sheet normal and radially in relation to the concentric rings, respectively, and to pass across a gap between two sheets or rings, producing undesirably low permeability values for the system as a whole. This would have to be compensated for by a significant increase in the coil current which would, however, simultaneously promote eddy currents in the sheet levels.

Spirally or involutely layered laminate stacks for reducing eddy currents are described in publications JP 2002 343626 AA and DE 103 94 029 T5.

A fuel injection valve for fuel injection systems in internal combustion engines with a soft magnetic magnet yoke arrangement is described in DE 10 2004 032 229 B3. The arrangement has a first yoke sheet and a second yoke sheet which are rolled together in a spiral.

DE 35 00 530 A1 proposes an electromagnetically operated control system to control a lift valve in an internal combustion engine in place of a mechanical cam control system.

SUMMARY

There remains a need for a laminate stack comprising individual soft magnetic sheets and an electromagnetic actuator, in particular an electromagnetic injection valve, which have particularly good magnetic properties, in particular for an electromagnetic coil system. There also remains a need for particularly simple processes for their manufacture.

These needs can be met by one or more of the embodiments disclosed herein.

Disclosed herein is a laminate stack comprising individual soft magnetic sheets, the individual sheets being curved involutely in the laminate stack. Each individual sheet comprises a first long side, a second long side opposite the first long side, a first short side and a second short side opposite the first short side. The first long side comprises a recess, said recess being rectangular and equidistant from the first short side, the second short side and the second long side when the individual sheet is in its uncurved state.

An involute, in particular a circular involute, is defined as the unwinding of the evolute tangent of the evolute of a circle. In embodiments described herein, the curve of the individual involute sheets is so small that the magnetic flux is able to flow essentially along the sheet planes such that the flux lines do not cross the sheet planes.

Due to the particular geometrical arrangement of the rectangular recess and the special dimensions of the individual sheets, respectively, embodiments of the laminate stack disclosed herein have significantly improved magnetic properties.

In a preferred embodiment, in its uncurved state each individual sheet is essentially U-shaped, a first leg having a width e, a second leg having a width g and a base having a thickness d, where e=g=d.

In a further embodiment, the laminate stack has an inner section and a base, the inner section having an inside radius $D_i$, a front face of the inner section having a surface $A_a$ and the base having a thickness d, where $$d = \frac{A_a}{\pi \cdot D_i}.$$

In a further embodiment the laminate stack has an inner section and a base, the inner section having an inside radius $D_i$ and a thickness a and the base having a thickness d, where $$d = \frac{(2 \cdot a + D_i)^2 - D_i^2}{4 \cdot D_i}.$$

In a further embodiment the laminate stack has an inner section, an outer section and a base, the inner section having an inside radius $D_i$, the outer section having an outside radius $D_a$ and a thickness c and the base having a thickness d, where $$d = \frac{D_a^2 - (D_a - 2 \cdot c)^2}{4 \cdot D_i}.$$

In one embodiment the laminate stack is rotationally symmetrical and composed of individual sheets of identical thickness t. It is therefore relatively easy to manufacture. In a further embodiment, the individual sheets are of different thicknesses, the thickness of each individual sheet being constant.

The involute is described parametrically in terms of Cartesian coordinates x and y by the equation $$\begin{pmatrix} x \\ y \end{pmatrix} = \begin{pmatrix} r \cdot \cos t^* + r \cdot t^* \cdot \sin t^* \\ r \cdot \sin t^* - r \cdot t^* \cdot \cos t^* \end{pmatrix} \quad (1')$$

with the parameter t*, where r is an inside radius of the laminate stack.

Ideally, the densest possible laminate stacking (stacking factor=1) is:

$$n \cdot t = 2 \cdot \pi \cdot r \quad (2'),$$

where t is the thickness and n the number of individual sheets. Preferred sheet thicknesses for a stack of this type lie in the region of 0.35 mm, thinner and thicker sheet thicknesses up to approximately 1 mm also being conceivable. The inside radius r of the magnet core is preferably between a few millimeters and over 10 mm.

Equation (1) gives the following for the outside radius R:

$$R = \sqrt{r^2 \cdot (1 + t^{*2})} \quad (3').$$

The use of an interlocking die is advantageous in achieving a particularly rational manufacturing process for a laminate stack of this type. However, this means that it must be possible to stack the sheets one on top of another. For $t^* \geq \pi$ it is no longer possible simply to place the individual sheets one on top of another. Due to the curve they have to be pushed into one another from the side. The relationship is therefore advantageously $t^* < \pi$.

The condition $t^* < \pi$ for an easily stackable laminate stack gives a maximum outside radius R of 9.9 mm for a typical inside radius of r=3 mm, or a minimum inside radius of r=3.64 mm for a typical external radius of R=12 mm.

In a preferred embodiment the laminate stack is essentially cylinder-shaped and comprises at least one annular recess, the annular recess being arranged concentrically in the laminate stack and formed essentially by the recesses in the individual sheets.

In one embodiment the individual sheets contain an alloy that consists essentially of:

12.0 percent by weight ≤Co≤22.0 percent by weight,
1.5 percent by weight ≤Cr≤4.0 percent by weight,
0.4 percent by weight ≤Mo≤1.2 percent by weight,
0.1 percent by weight ≤V≤0.4 percent by weight,
0.05 percent by weight ≤Si≤0.15 percent by weight,
and the remainder Fe.

In particular, the alloy of the individual sheets may consist essentially of 17.0 percent by weight Co, 2.2 percent by weight Cr, 0.8 percent by weight Mo, 0.2 percent by weight V, 0.09 percent by weight Si and the remainder Fe.

In a further embodiment the alloy of the individual may sheet consist essentially of:

12.0 percent by weight ≤Co≤22.0 percent by weight,
1.5 percent by weight ≤Cr≤4.0 percent by weight,
1.0 percent by weight ≤Mn≤1.8 percent by weight,
0.4 percent by weight ≤Si≤1.2 percent by weight,
0.1 percent by weight ≤A≤0.4 percent by weight,
and the remainder Fe.

In particular, the alloy of the individual sheets may consist essentially of 18.0 percent by weight Co, 2.6 percent by weight Cr, 1.4 percent by weight Mn, 0.8 percent by weight Si, 0.2 percent by weight Al and the remainder Fe.

In a further embodiment the alloy of the individual sheets may consist essentially of:

12.0 percent by weight ≤Co≤22.0 percent by weight,
1.0 percent by weight ≤Cr≤2.0 percent by weight,
0.5 percent by weight ≤Mn≤≤1.5 percent by weight,
0.6 percent by weight ≤Si≤1.8 percent by weight,
0.1 percent by weight ≤V≤0.2 percent by weight,
and the remainder Fe.

In particular the alloy of the individual sheets may consist essentially of 17.0 percent by weight Co, 1.4 percent by weight Cr, 1.0 percent by weight Mn, 1.2 percent by weight Si, 0.13 percent by weight V, and the remainder Fe.

In a further embodiment the alloy of the individual sheets may consist essentially of:

15 percent by weight ≤Co≤18.0 percent by weight,
0 percent by weight ≤Mn≤3.5 percent by weight,
0 percent by weight ≤Si≤1.8 percent by weight,
and the remainder Fe.

In particular the alloy of the individual sheets may consist essentially of 15 percent by weight ≤Co≤18.0 percent by weight and the remainder Fe, or essentially of 15 percent by weight ≤Co, 1 percent by weight Si and the remainder Fe, or essentially of 15 percent by weight ≤Co, 2.7 percent by weight Mn and the remainder Fe.

In a further embodiment the alloy of the individual sheets may consist essentially of:

0 percent by weight <Ni<5.0 percent by weight,
0 percent by weight <Co<1.0 percent by weight,
0 percent by weight <C<0.03 percent by weight,
0 percent by weight <Si<0.5 percent by weight,
0 percent by weight <S<0.03 percent by weight,
0 percent by weight <Al<0.08 percent by weight,
0 percent by weight <Ti<0.1 percent by weight,
0 percent by weight <V<0.1 percent by weight,
0 percent by weight <P<0.015 percent by weight,
0.03 percent by weight <Mn<0.2 percent by weight,
and the remainder Fe.

In a further embodiment the alloy of the individual sheets may consist essentially of:

0 percent by weight <Ni<5.0 percent by weight,
0 percent by weight <Co<1.0 percent by weight,
0 percent by weight <C<0.1 percent by weight,
0 percent by weight <Si<4.5 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight,
and the remainder Fe.

In a further embodiment the alloy of the individual sheets may consist essentially of:

5 percent by weight <Cr<23.0 percent by weight,
0 percent by weight <Ni<8.0 percent by weight,
0 percent by weight <Co<1.0 percent by weight,
0 percent by weight <C<0.1 percent by weight,
0 percent by weight <Si<4.0 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight,
and the remainder Fe.

In a further embodiment the alloy of the individual sheets may consist essentially of:

20 percent by weight <Ni<85.0 percent by weight, 0 percent by weight <Co<1.0 percent by weight, 0 percent by weight <C<0.1 percent by weight, 0 percent by weight <Si<4.0 percent by weight, 0 percent by weight <S<0.1 percent by weight, 0 percent by weight <Al<2.0 percent by weight, 0 percent by weight <Mo<5.0 percent by weight, 0 percent by weight <Mn<4.0 percent by weight, 0 percent by weight <Cu<5.0 percent by weight, and the remainder Fe.

In a further embodiment an alloy for the soft magnetic individual sheets has the following composition in percent by weight: $Fe_{rem}Co_aCr_bS_cMo_dSi_eAl_fMn_gM_hV_iNi_jC_kCu_lP_mN_nO_oB_p$ with $0\%\leq a\leq 50\%$, $0\%\leq b\leq 20\%$, $0\%\leq c\leq 0.5\%$, $0\%\leq d\leq 3\%$, $0\%\leq e\leq 3.5\%$, $0\%\leq f\leq 4.5\%$, $0\%\leq g\leq 4.5\%$, $0\%\leq h\leq 6\%$, $0\%\leq i\leq 4.5\%$, $0\%\leq j\leq 5\%$, $0\%\leq k<0.05\%$, $0\%\leq l\leq 1\%$, $0\%\leq m<0.1\%\leq n<0.5\%$, $0\%\leq o<0.05\%$, $0\%\leq p<0.01\%$, where M is at least one of the elements Sn, Zn, W, Ta, Nb, Zr and Ti.

In a further embodiment the soft magnetic individual sheets essentially have the composition in percent by weight $Fe_{rem}Co_{17}Cr_2$ or $Fe_{rem}Co_a$ with $3\leq a\leq 25$. In a further embodiment the individual soft magnetic sheets consist of pure iron or a chrome steel—in particular where a high level of anti-corrosion behaviour is required—or they are provided as silicated electroplates.

To further reduce the formation of eddy currents, in a preferred embodiment the individual soft magnetic sheets forming the laminate stack have an electrically insulating coating on at least one side. Depending on the requirements and the coating technique used they may also be coated with the insulation on both sides.

In a further preferred embodiment magnesium oxide (MgO) is provided as the electrically insulating coating. In an alternative embodiment it is also possible to provide a coating with zirconium oxide ($ZrO_2$). In addition or alternatively magnetite ($Fe_3O_4$) or haematite ($Fe_2O_3$) or a self-oxidising layer can be provided as the electrically insulating coating.

In a further embodiment the laminate stack has at least one opening, the at least one opening forming a leadthrough for incoming and outgoing electrical lines of a coil.

Also disclosed herein is to an electromagnetic actuator comprising a soft magnetic core, the soft magnetic core comprising at least one laminate stack in accordance with one of the preceding embodiments.

In one embodiment the electromagnetic actuator is formed as an inlet/outlet valve.

In a further embodiment the actuator is formed as an injection valve for controlling a fuel quantity to be fed into an internal combustion engine.

The injection valve may have a valve body which can be moved towards a valve seat by an electromagnetic coil system and which is connected to a soft magnetic magnet armature of the electromagnetic coil system, the electromagnetic coil system comprising at least one coil with the soft magnetic core.

A composition of the soft magnetic core having sheet-type structures is particularly suitable for reducing eddy currents. However, in order to benefit from the advantages of these sheet-type structures, the magnetic flux should be able to run along the individual sheets when the injection valve is in operation and cross as few individual sheets as possible. Crossing more than a few individual sheets would result in considerable losses. Particularly preferred is the manufacture of individual sheets of constant thickness. Due to their involute arrangement for providing a laminate stack they can be used to build a radially symmetrical core in which the magnetic flux is able to run essentially parallel to the sheet plane, thereby minimising the losses. Due to this laminate stack design the magnet core also has particularly low eddy current losses.

A further advantage of the injection valve described herein is the fact that it is possible to use laminate stack materials which are not suited to sintering and pressing and thus could not previously be considered for the manufacture of a pressed or sintered magnet core, but which nevertheless have good magnetic properties such as, for example, high saturation polarisation. Alloys with high saturation polarisation generally simultaneously present the disadvantage of low electrical specific resistance and thus favour the occurrence of eddy currents. While the saturation polarisation is influenced primarily by the alloy composition of the magnet core, now however electrical resistance is also influenced by its geometry, namely by the design of the magnet core as a laminate stack.

Thus it becomes possible using a laminate stack as described herein to decouple the saturation polarisation and electrical resistance variables and so to obtain a magnet core which has high values for both variables. With a magnet core of this type it is possible to achieve both short injection valve switching times on one hand and low magnetisation switching losses and high retention forces on the other. The injection valve is therefore particularly suitable for direct injection in motor vehicles for which high retention forces are required due to the high fuel pressure and short switching times that are required to ensure economic operation.

The soft magnetic core and/or the soft magnetic magnet armature are preferably arranged concentrically to a central axis of the injection valve. The valve body connected to the magnet armature is biased in an open or closed position of the injection valve by a spring element and can be moved into the closed or open position by passing a current through the electromagnetic coil system.

In a preferred embodiment the soft magnetic core is essentially cylindrical and has at least one circular recess for receiving the coil, the circular recess being arranged concentrically in the soft magnetic core and formed essentially by the recesses in the individual sheets.

A process for the manufacture of a laminate stack in accordance with the invention comprises the following steps: First, individual soft magnetic sheets are manufactured and formed. Each individual sheet comprises a first long side, a second long side opposite the first long side, a first short side and a second short side opposite the first short side. The first long side comprises a recess, when the individual sheet is in its uncurved stated said recess being rectangular and equidistant from the first short side, the second short side and the second long side. In a subsequent step the individual sheets are first curved to form an involute and then stacked to form a laminate stack.

In this process the individual sheets are preferably manufactured and formed to the same thickness. The individual sheets may also be manufactured and formed in such a manner that they have different thicknesses, each individual sheet being of constant thickness.

The individual sheets in a laminate stack may each contain an alloy that has the same composition as the alloy in every other sheet in the laminate stack. Alternatively, a laminate stack may contain sheets having different alloy compositions.

The forming of the individual sheets is achieved by stamping, wire eroding or cutting, for example.

In a preferred embodiment the individual sheets are given an electrically insulating coating before or after the stacking of the individual sheets to form the laminate stack. This coating may take the form of spraying or dipping and/or oxidation in air or steam, for example.

Also disclosed is an electromagnetic activator comprising a soft magnetic core comprising at least one laminate stack as described herein.

BRIEF DESCRIPTION OF DRAWINGS

Embodiments disclosed herein are explained in greater detail below with reference to the attached figures.

DETAILED DESCRIPTION OF SPECIFIC EMBODIMENTS

Figure 1:
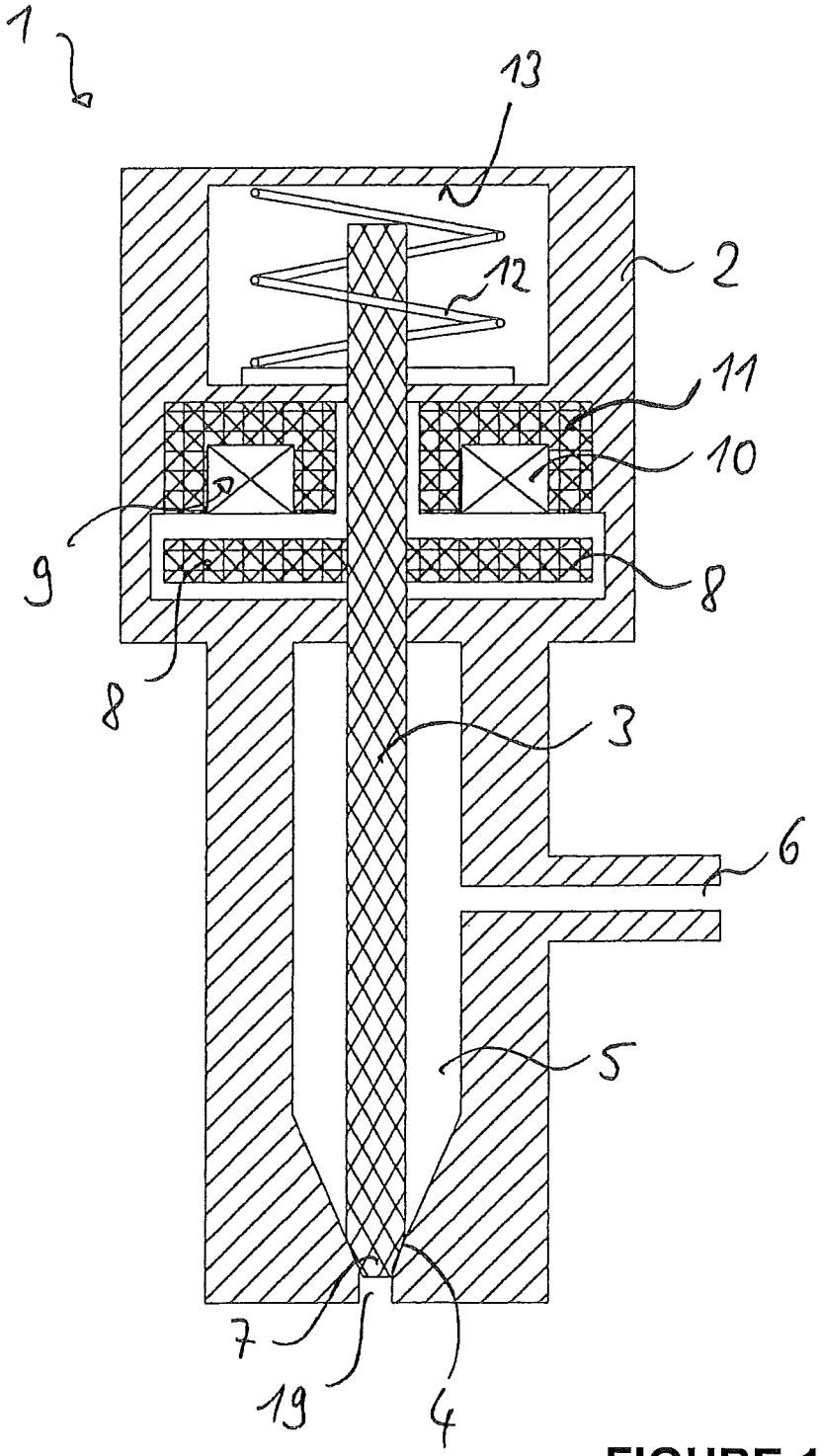
FIG. 1 illustrates a schematic cross-section through an injection valve as disclosed in one embodiment.

In one embodiment the alloy of the individual sheets may consist essentially of:

12.0 percent by weight ≤Co≤22.0 percent by weight,
1.5 percent by weight ≤Cr≤4.0 percent by weight,
0.4 percent by weight ≤Mo≤1.2 percent by weight,
0.1 percent by weight ≤V≤0.4 percent by weight,
0.05 percent by weight ≤Si≤0.15 percent by weight,
and the remainder Fe.

In particular, the alloy of the individual sheets may consist essentially of 17.0 percent by weight Co, 2.2 percent by weight Cr, 0.8 percent by weight Mo, 0.2 percent by weight V, 0.09 percent by weight Si and the remainder Fe.

In a further embodiment the alloy of the individual sheets may consist essentially of:

12.0 percent by weight ≤Co≤22.0 percent by weight,
1.5 percent by weight ≤Cr≤4.0 percent by weight,
1.0 percent by weight ≤Mn≤1.8 percent by weight,
0.4 percent by weight ≤Si≤1.2 percent by weight,
0.1 percent by weight ≤A≤10.4 percent by weight,
and the remainder Fe.

In particular the alloy of the individual sheets may consist essentially of 18.0 percent by weight Co, 2.6 percent by weight Cr, 1.4 percent by weight Mn, 0.8 percent by weight Si, 0.2 percent by weight Al and the remainder Fe.

In a further embodiment the alloy of the individual sheets may consist essentially of:

12.0 percent by weight ≤Co≤22.0 percent by weight,
1.0 percent by weight ≤Cr≤2.0 percent by weight,
0.5 percent by weight ≤Mn≤1.5 percent by weight,
0.6 percent by weight ≤Si≤1.8 percent by weight,
0.1 percent by weight ≤V≤0.2 percent by weight,
and the remainder Fe.

In particular the alloy of the individual sheets may consist essentially of 17.0 percent by weight Co, 1.4 percent by weight Cr, 1.0 percent by weight Mn, 1.2 percent by weight Si, 0.13 percent by weight V and the remainder Fe.

In a further embodiment the alloy of the individual sheets consist essentially of:

15 percent by weight ≤Co≤18.0 percent by weight,
0 percent by weight ≤Mn≤3.5 percent by weight,
0 percent by weight ≤Si≤1.8 percent by weight,
and the remainder Fe.

In particular the alloy of the individual sheets may consist essentially of 15 percent by weight ≤Co≤18.0 percent by weight and the remainder Fe, or essentially of 15 percent by weight ≤Co, 1 percent by weight Si and the remainder Fe, or essentially of 15 percent by weight ≤Co, 2.7 percent by weight Mn and the remainder Fe.

In a further embodiment the alloy of the individual sheets may consist essentially of:

0 percent by weight <Ni<5.0 percent by weight,
0 percent by weight <Co<1.0 percent by weight,
0 percent by weight <C<0.03 percent by weight,
0 percent by weight <Si<0.5 percent by weight,
0 percent by weight <S<0.03 percent by weight,
0 percent by weight <Al<0.08 percent by weight,
0 percent by weight <Ti<0.1 percent by weight,
0 percent by weight <V<0.1 percent by weight,
0 percent by weight <P<0.015 percent by weight,
0.03 percent by weight <Mn<0.2 percent by weight,
and the remainder Fe.

In a further embodiment the alloy of the individual sheets may consist essentially of:

0 percent by weight <Ni<5.0 percent by weight,
0 percent by weight <Co<1.0 percent by weight,
0 percent by weight <C<0.1 percent by weight,
0 percent by weight <Si<4.5 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight,
and the remainder Fe.

In a further embodiment the alloy of the individual sheets may consist essentially of:

5 percent by weight <Cr<23.0 percent by weight,
0 percent by weight <Ni<8.0 percent by weight,
0 percent by weight <Co<1.0 percent by weight,
0 percent by weight <C<0.1 percent by weight,
0 percent by weight <Si<4.0 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight,
and the remainder Fe.

In a further embodiment the alloy of the individual sheets may consist essentially of:

20 percent by weight <Ni<85.0 percent by weight,
0 percent by weight <Co<1.0 percent by weight,
0 percent by weight <C<0.1 percent by weight,
0 percent by weight <Si<4.0 percent by weight,
0 percent by weight <S<0.1 percent by weight,
0 percent by weight <Al<2.0 percent by weight,
0 percent by weight <Mo<5.0 percent by weight,
0 percent by weight <Mn<4.0 percent by weight,
0 percent by weight <Cu<5.0 percent by weight,
and the remainder Fe.

In a further embodiment an alloy for the individual soft magnetic sheets has the following composition in percent by weight: $Fe_{rem}Co_aCr_bS_cMo_dSi_eAl_fMn_gM_hV_iNi_jC_kCu_lP_mN_nO_oB_p$ with $0\%\leq a\leq 50\%$, $0\%\leq b\leq 20\%$, $0\%\leq c\leq 0.5\%$, $0\%\leq d\leq 3\%$, $0\%\leq e\leq 3.5\%$, $0\%\leq f\leq 4.5\%$, $0\%\leq g\leq 4.5\%$, $0\%\leq h\leq 6\%$, $0\%\leq i\leq 4.5\%$, $0\%\leq j\leq 5\%$, $0\%\leq k<0.05\%$, $0\%\leq l\leq 1\%$, $0\%\leq m<0.1\%\leq n<0.5\%$, $0\%\leq o<0.05\%$, $0\%\leq p<0.01\%$, where M is at least one of the elements Sn, Zn, W, Ta, Nb, Zr and Ti.

In a further embodiment the soft magnetic individual sheets may essentially have the composition in percent by weight $Fe_{rem}Co_{17}Cr_2$ or $Fe_{rem}Co_a$ with $3\leq a\leq 25$. In a further embodiment the individual soft magnetic sheets may consist of pure iron or a chrome steel—in particular where a high level of anti-corrosion behaviour is required—or they are provided as silicated electroplates.

In a further embodiment at least one opening is made in the laminate stack, the at least one opening forming a leadthrough for incoming and outgoing electrical lines of a coil.

As disclosed herein, a process for the manufacture of an electromagnetic actuator comprises the following steps: A laminate stack is manufactured as disclosed in one of the aforementioned embodiments of the process for the manufacture of a laminate stack. In addition, a soft magnetic core is shaped from the laminate stack for the electromagnetic actuator.

As disclosed herein, a process for the manufacture of an injection valve for controlling a fuel quantity to be fed into an internal combustion engine comprises the following steps: A laminate stack is manufactured as disclosed in one of the aforementioned embodiments of the process for the manufacture of a laminate stack. In addition, a soft magnetic core is shaped from the laminate stack for an electromagnetic coil system of the injection valve.

Also disclosed herein is the use of a soft magnetic laminate stack as disclosed in one of the aforementioned embodiments made of layered, individual involute soft magnetic sheets in an electromagnetic actuator.

In one embodiment, the use of a soft magnetic laminate stack as disclosed in one of the aforementioned embodiments made of layered, individual involute soft magnetic sheets is in an injection valve for controlling a quantity of fuel to be fed into an internal combustion engine.

The expression "the alloy may consist essentially of" or "the alloy consists essentially of" in any embodiments mentioned herein denotes that the individual sheets comprise the elements mentioned in the respective embodiment in the concentration provided therein and may further comprise impurities in a total amount of up to 2.0 percent by weight. The impurities may include one or more of Ni, Cr, Mn, Si, Cu, Mo, Co, Al, C, S, V, Nb, Ti, Zr, Ta, O, N and P. Unless the concentration of said elements is already provided in the respective embodiment, the upper limit of said elements, if present, is Ni<1.0 percent by weight,
Cr<1.0 percent by weight,
Mn<1.0 percent by weight,
Si<0.3 percent by weight,
Cu<0.4 percent by weight,
Mo<0.5 percent by weight,
Co<1.0 percent by weight,
Al<0.1 percent by weight,
C<0.1 percent by weight,
S<1.0 percent by weight,
V<0.1 percent by weight,
Nb<0.1 percent by weight,
Ti<0.1 percent by weight,
Zr<0.1 percent by weight,
Ta<0.2 percent by weight,
O<0.1 percent by weight,
N<0.1 percent by weight,
P<0.1 percent by weight.

In the figures identical parts are identified by means of the same reference numerals.

The injection valve 1 disclosed in the sectional view shown in FIG. 1 has a housing 2 with a valve body 3 which can be moved towards and away from a valve seat 4 inside the housing 2. In the illustrated embodiment the valve body 3 is biased in a closed position of the injection valve 1 by a spring element 12. In this arrangement the spring element 12 exerts a force on the valve body 3 and presses it against the valve seat 4.

Fuel reaches the inside 5 of the valve through a fuel inlet 6 and is able to reach a combustion chamber through a fuel outlet 19 when the injection valve 1 is open.

Alternatively, it is also possible to arrange the fuel inlet 6 in the upper region of the injection valve 1 for example, so that the fuel is able to flow into the inside 5 from above.

An electromagnetic coil system 9 is provided to actuate the injection valve 1. The electromagnetic coil system 9 comprises a magnet armature 8 positioned on the valve body 2, at least one coil 10 through which current can be passed by a supply current (not illustrated) and a magnet core 11. In the embodiment shown the magnet core 11 is pot-shaped and receives the coil 10.

Passing current through the coil 10 generates a magnetic field in the magnet core 11 which attracts the magnet armature 8 such that it moves upwards and the tip 7 of the valve body 3 lifts out of the valve seat 4, thus opening the fuel outlet 19. The upward movement of the valve body 3 compresses the spring element 12 and presses it against an upper stop 13. Once the exciting current has been switched off, the valve body 3 is returned by the spring element 12 and the valve therefore closes again.

Figure 2A:
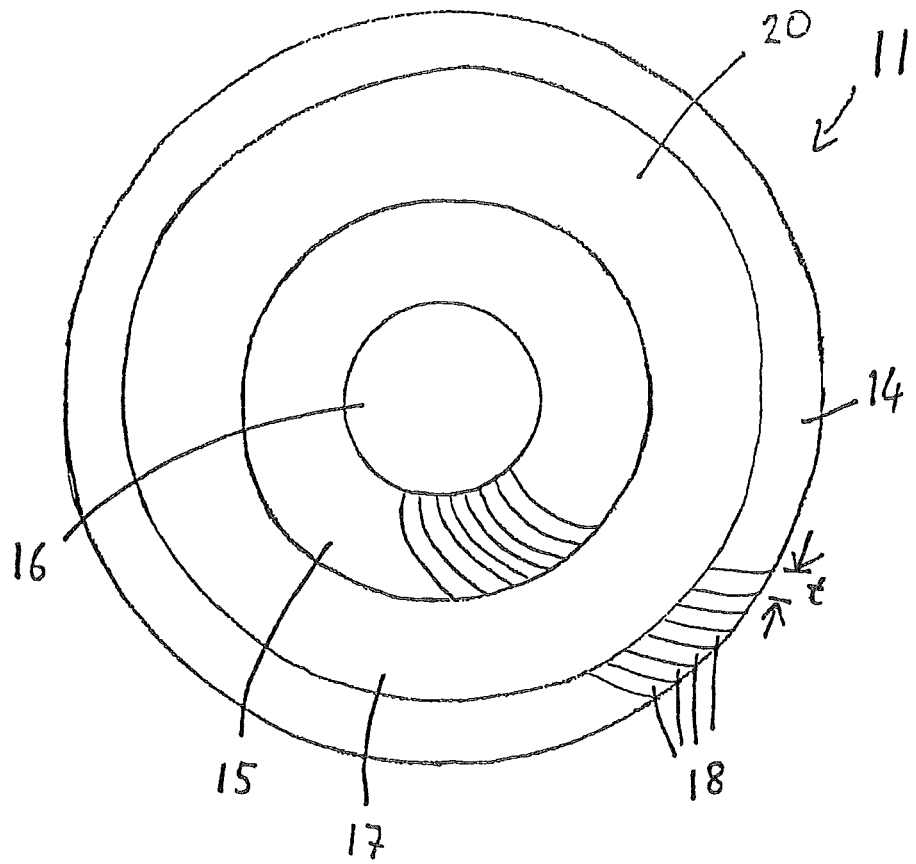
FIG. 2A shows a schematic top view of a magnet core as disclosed herein, inverted from the position shown in FIG. 1.

FIG. 2A illustrates a schematic top view of an embodiment of a magnet core 11 as disclosed herein. In this embodiment the magnet core 11 is pot-shaped and has an inner section 15 and an outer section 14 between which lies a recess 17 for a coil. The bottom of the recess 17 is closed off by a base 20. At its centre the magnet core 11 has a cylindrical central hole 16 through which the valve body passes when the valve is assembled and which has a longitudinal axis which essentially forms the axis of symmetry of the magnet core 11.

The outer section 14, the inner section 15 and the base 20 are formed by a laminate stack consisting of a multiplicity of individual sheets 18 as indicated in a section of FIG. 2A. In this arrangement each individual sheet 18 is approximately U-shaped and has U regions as legs which after stacking form the outer section 14 and the inner section 15 in the laminate stack. To this end each individual sheet 18 has a rectangular recess on a first long side of the individual sheet 18. When the individual sheet 18 is in its uncurved state this recess 25 (shown in FIG. 5) is defined by edges each of which is equidistant from a first short side of the individual sheet 18 and from a second short side opposite the first short side of the individual sheet 18 and from a second long side opposite the first long side of the individual sheet 18, respectively. This permits particularly favourable magnetic properties to be achieved for the laminate stack as explained in greater detail with reference to the following figures. In the embodiment illustrated, all the individual sheets 18 are of the same thickness t and are layered one above the other or side by side in an involute.

Figure 2B:
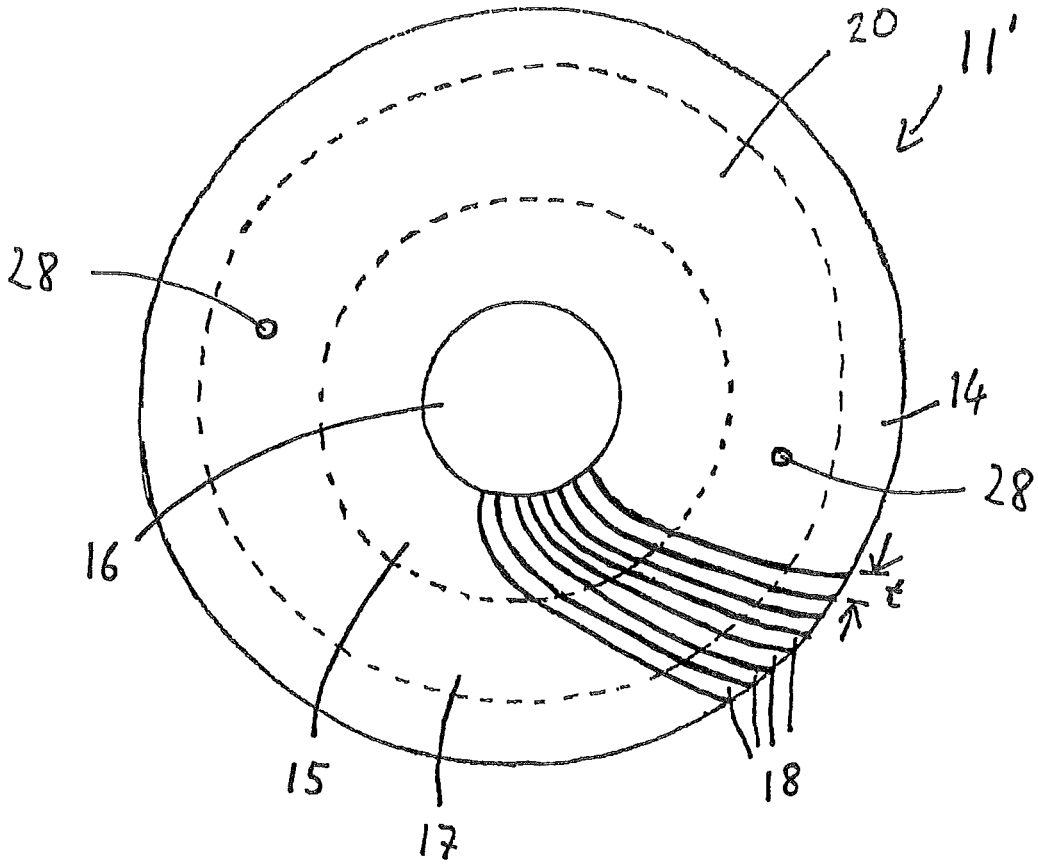
FIG. 2B illustrates a schematic view from below of an embodiment of magnet core as disclosed herein, inverted from the position shown in FIG. 1.

FIG. 2B illustrates a schematic view from below of a magnet core 11' as disclosed in a, further embodiment. In this embodiment the magnet core 11' is also pot-shaped and comprises an inner section 15 and an outer section 14 between which lies a recess 17 for a coil. The recess 17 is not visible in the view from below and is therefore illustrated by means of a broken line in FIG. 2B. A base 20 closes off the bottom of the magnet core 11'. In the centre the magnet core 11' has a cylindrical central hole (16) through which the valve body passes when the valve is assembled and which has a longitudinal axis which essentially forms the axis of symmetry of the magnet core 11'.

The outer section 14, the inner section 15 and the base 20 are formed by a laminate stack comprising a multiplicity of individual sheets 18 as indicated in the section in FIG. 2B. In the illustrated embodiment, all the individual sheets 18 are of the same thickness t and are layered one above the other or side by side in an involute.

In addition, the base 20 of the magnet core 11' has two openings 28 in the form of holes, for example. In this arrangement the openings 28 form leadthroughs for the incoming and outgoing electrical lines of the coil. In the illustrated embodiment the two openings 28 both have a diameter in a range of 1 mm to 3 mm, for example. In addition the two openings 28 are preferably arranged rotationally symmetrically in order that the magnet core 11' may be rotationally symmetrical.

In a further embodiment the magnet core has only one opening with a diameter of 3 mm to 6 mm, for example, which forms a leadthrough for both the incoming and outgoing electrical lines. More than two openings may be provided in further embodiments.

Figure 3:
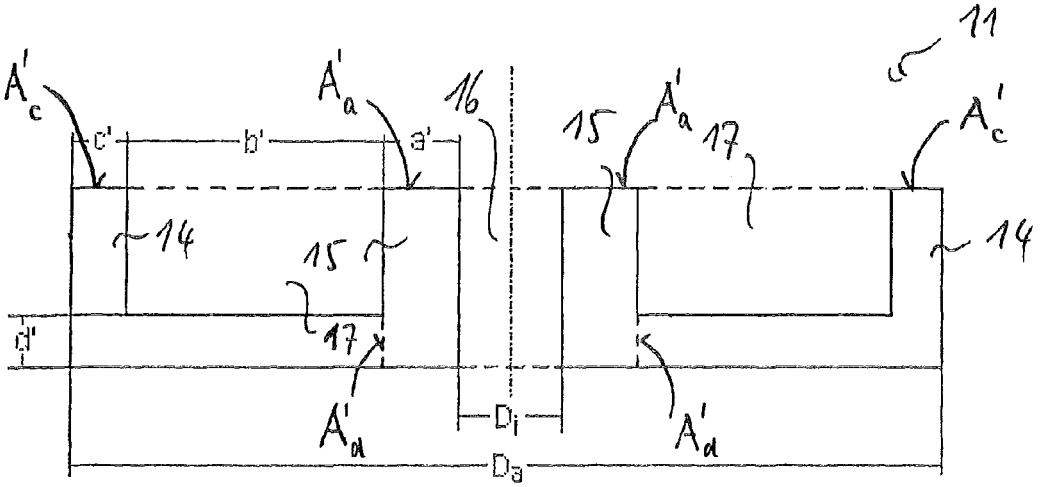
FIG. 3 illustrates a schematic cross-section through the central axis of a rotationally symmetrical magnet core made of a solid material.

For the purposes of comparison, FIG. 3 shows a schematic cross-section through the central axis of a rotationally symmetrical magnet core made of a solid material rather than from a laminated stack as disclosed herein. The magnet core is designed as a pot magnet which can be manufactured from solid material by means of turning, milling and/or drilling, for example. The magnet core 11 has an inner section 15 and an outer section 14 between which lies a recess 17 for a coil. In the centre the magnet core 11 has a cylindrical central hole 16 through which the valve body passes when the valve is assembled and which has a longitudinal axis which essentially forms the axis of symmetry of the magnet core 11.

The course of the magnetic flux in the pot magnet made of solid material may be as described below. Supposing the magnetic flux in the pot magnet is constant, i.e. disregarding the lost fluxes, which is fulfilled for highly permeable materials with a relative permeability $\mu>1000$, the magnetic flux densities should be equal at the narrow points. Thus the three critical faces $A_c'$ (front face of outer section 14 in the form of an outer ring), $A_a'$ (front face of the inner section 15 in the form of an inner ring) and $A_d'$ (outer envelope surface of the inner section 15 in the form of the inner ring with a height d') should have the same square measure:

$$A_c'=A_a'=A_d' \tag{1}$$

The magnetic flux penetrates the front face $A_c'$ of the outer ring. The following applies to surface $A_c'$:

$$A_c' = \frac{1}{4}\cdot(D_a^2-(D_a-2\cdot c')^2)\cdot\pi, \tag{2}$$

where $D_a$ is the outer radius of the pot magnet and c' is the thickness of the outer section 14. The flux exits the pot magnet at the front face $A_a'$. $A_a'$ is determined by the equation:

$$A_a' = \frac{1}{4}\cdot((2\cdot a'+D_i)^2-D_i^2)\cdot\pi, \tag{3}$$

where $D_i$ is the inner radius of the pot magnet and a' is the thickness of the inner section 15. To pass from $A_a'$ to $A_c'$ the flux must pass through the envelope surface $A_d'$. The latter is:

$$A_d'=d'\cdot(2\cdot a'+D_i)\cdot\pi. \tag{4}$$

Equations (1) to (4) should be taken into account when selecting the dimensions of a solid pot magnet.

Figure 4:
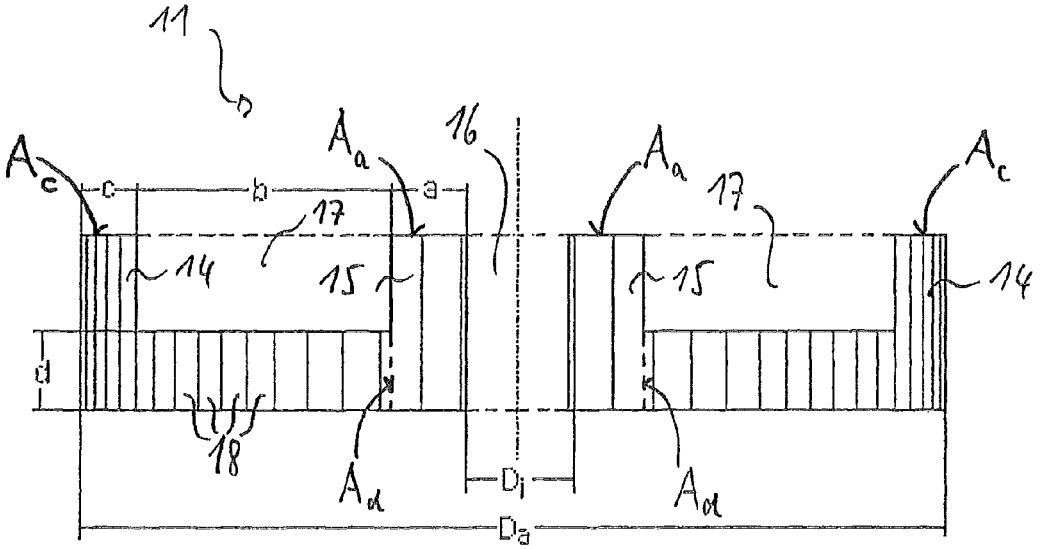
FIG. 4 illustrates a schematic cross-section through the central axis of an embodiment of a rotationally symmetrical magnet core as disclosed herein in the form of an involute laminate stack.

FIG. 4 shows a schematic cross-section through the central axis of a rotationally symmetrical magnet core as disclosed in the invention in the form of an involute laminate stack comprising individual sheets 18. The magnet core is designed as a pot magnet and has an inner section 15 and an outer section 14 between which lies a recess 17 for a coil. In the centre the magnet core 11 has a cylindrical central hole 16 through which the valve body passes when the valve is assembled and which has a longitudinal axis which essentially forms the axis of symmetry of the magnet core 11.

The course of the magnetic flux in the pot magnet made of involutely-shaped individual sheets may be as described below. A laminate stack filling factor of approximately 100% is assumed.

Figure 5:
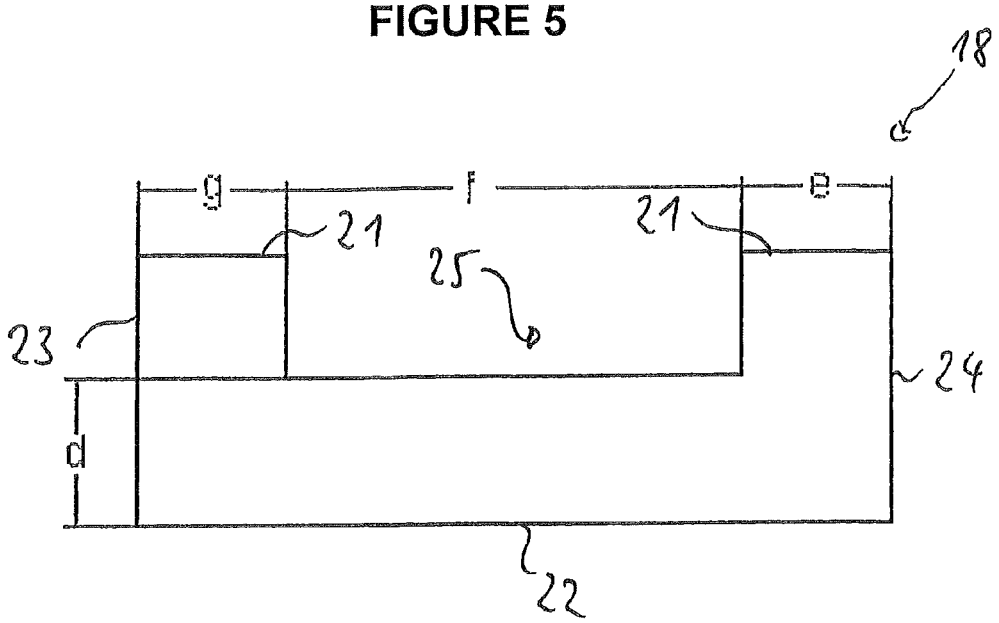
FIG. 5 illustrates a schematic cross-section through an individual sheet of an embodiment of the rotationally symmetrical magnet core disclosed herein when the individual sheet is in its uncurved state.

As for the solid material magnet core illustrated in FIG. 3, the following condition should be fulfilled for the pot magnet made of involute sheets:

$$A_c=A_a=A_{d,f} \tag{5}$$

where $A_c$ is the front face of the outer section 14 in the form of an outer ring, $A_a$ is the front face of the inner section 15 in the form of an inner ring and $A_{d,f}$ is the cross-sectional face of a flat curved individual sheet, as illustrated in FIG. 5, multiplied by the number of individual sheets.

The same front face conditions apply to the front faces of the pot magnet made of individual involute sheets as to the solid pot magnet, i.e.:

$$A_c'=A_c, \tag{6}$$

and $$A_a'=A_a, \tag{7}$$

since the surface normals of these surfaces run parallel to the magnetic flux in both pot magnet variants. Thus the dimensions of the front faces are identical:

$$c'=c \text{ and } a'=a. \tag{8}$$

The vectorial relationships of surfaces $A_d$ and $A_d'$ are not identical, as is explained in greater detail below with reference to FIG. 6.

FIG. 5 illustrates a schematic cross-section through an individual sheet 18 of the rotationally symmetrical magnet core disclosed in the invention when the individual sheet 18 is in its uncurved state.

The individual sheet 18 comprises a rectangular recess 25 on a first long side 21 of the individual sheet 18. In addition, the individual sheet 18 comprises a second long side 22 opposite the first long side 21, a first short side 23 and a second short side 24 opposite the first short side 23.

The number n of individual sheets with sheet thickness t at a 100% laminate stack filling factor is $$n = \frac{D_i \cdot \pi}{t}, \tag{9}$$

since the individual sheets meet perpendicularly at the inner surface described by $D_i$. Observing at the flattened individual sheet, the front face $A_c$ can be calculated with $$A_c = \frac{1}{4} \cdot (D_a^2 - (D_a - 2 \cdot c)^2) \cdot \pi = n \cdot t \cdot g \tag{10}$$

not only using the dimensions of the pot magnet, but also with the dimensions of the uncurved individual sheet 18, where g is the distance from the recess 25 to the first short side 23. The same applies by for front face $A_a$ $$A_a = \frac{1}{4} \cdot ((2 \cdot a + D_i)^2 - Di^2) \cdot \pi = n \cdot t \cdot e, \tag{11}$$

where e is the distance from the recess 25 to the second short side 24. The major difference between the two pot magnet variants lies in the envelope surfaces $A_d$ and $A_d'$. Looking again at the individual sheet as disclosed in FIG. 5, the equation for the pot magnet made of individual involute sheets is $$A_{dj} = n \cdot t \cdot d, \tag{12}$$

where d is the distance from the recess (25) to the second long side 22.

Because $$A_d > A_d', \tag{13}$$

i.e. the outer envelope surface of the pot magnet made of individual involute sheets should always be greater than the outer envelope surface of the solid pot magnet, d should be increased accordingly. According to equations (5), (10), (11) and (12), the condition for a pot magnet made of individual involute sheets is $$e = g = d. \tag{14}$$

This condition therefore means that the recess on a first long side of the individual sheet 18 when the individual sheet 18 is in the uncurved state is essentially rectangular and is equidistant from a first short side of the individual sheet 18, from a second short side of the individual sheet 18 opposite the first short side and from a second long side of the individual sheet 18 opposite the first long side. This makes it possible to achieve particularly good magnet core properties.

Figure 6:
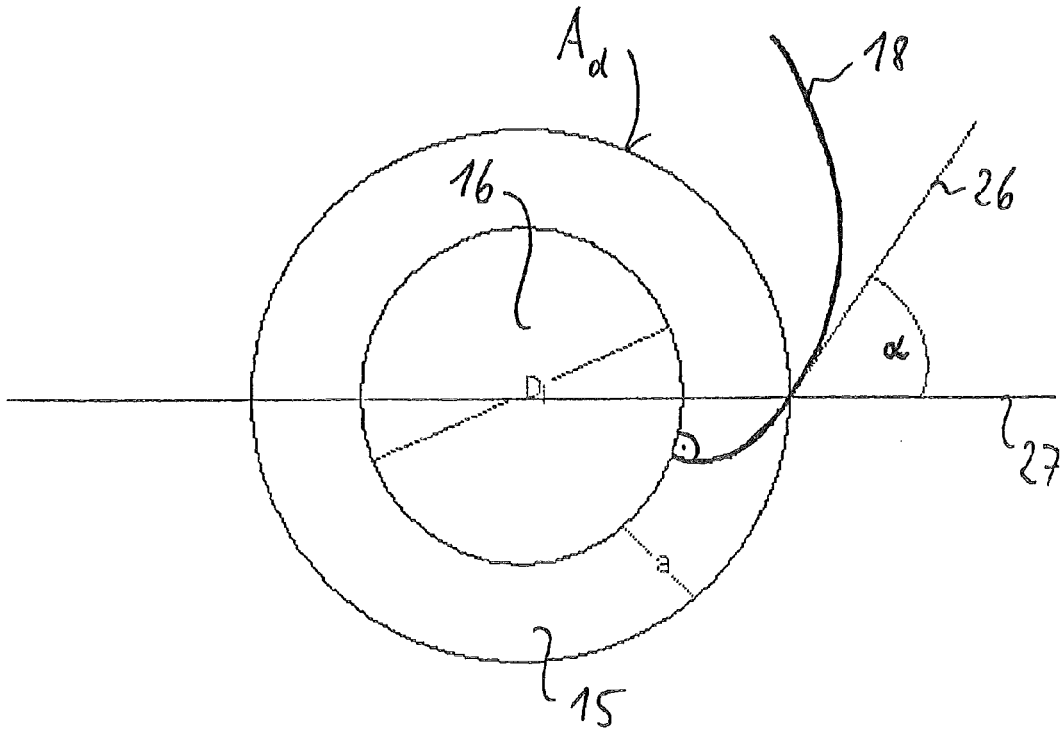
FIG. 6 illustrates a schematic top view of an embodiment of individual involute sheet in an inner part of the magnet core herein.

A further condition is specified in connection with FIG. 6. FIG. 6 illustrates a schematic top view of an individual involute sheet in a magnet core as disclosed in the invention which is designed in the illustrated embodiment as a pot magnet.

It is fundamental that in a solid magnet core the magnetic flux flows radially through the base of the pot magnet. It flows through the surface $A_d'$ radially and hits $A_d'$ at a 90° angle, respectively.

In a pot magnet made of individual involute sheets the flux flows along the involute form of the individual sheet. Here the magnetic flux does not flow through the surface $A_d$ radially and does not hit $A_d$ at a 90° angle, respectively. The angle α illustrated in FIG. 6 is the angle enclosed by the tangent to the individual sheet 18 and the surface normal to the outer envelope surface $A_d$ of the inner section 15 at the point of intersection of the individual sheet 18 with the outer envelope surface $A_d$. In other words, the angle α is the angle enclosed by the tangent 26 to the individual sheet 18 at the point of intersection between the individual sheet 18 and the circle with the diameter (Di+2a) and the straight line 27 through this point of intersection and the centre point of the concentric circles or concentric rings. This angle α is always less than 90°. The angle α should be taken into account when selecting the dimensions since it reduces the radial components of the magnetic flux and the magnetic flux density.

The angle α can be calculated from parameters $D_i$ and a according to the following relationship:

$$\cos\alpha = \frac{D_i}{D_i + 2 \cdot a}. \tag{15}$$

To calculate the magnetic flux density $|\vec{B}| = |\vec{\Phi}|/|\vec{A}|$ with the magnetic flux $\vec{\Phi}$ and the surface $\vec{A}$ the vectorial relationships must be taken into account. The following, relationship applies to the radial components $\Phi_\perp$ of the flux which hits $A_d$ perpendicularly:

$$\Phi_\perp = |\vec{\Phi}| \cdot \cos\alpha. \tag{16}$$

This gives the following equation required to maintain the magnetic flux densities constant in the surfaces in accordance with equations (1) and (5):

$$d = d'/\cos\alpha \text{ and } A_d = A_{dj}/\cos\alpha = A_a/\cos\alpha = A_a'/\cos\alpha, \tag{17}$$

where $A_d$ is the envelope surface of the inner section 15 in the form of the inner right with a height d. With equation (15) this gives $$d = \frac{d' \cdot (2 \cdot a + D_i)}{D_i}. \tag{18}$$

The thickness d of the pot base in a magnet core, for example a pot magnet, made of involute sheets should be greater than thickness d' of the solid pot magnet by a factor of 1/cos α and of $$\frac{(2 \cdot a + D_i)}{D_i},$$

respectively.

With equations (1), (4), (7) and (8) equation (17) produces the relationship $$d = \frac{A_a}{(2a + D_i) \cdot \pi \cdot \cos\alpha} \tag{19}$$

and with equations (15) and (7) it produces the relationship $$d = \frac{A_a \cdot (2 \cdot a + D_i)}{(2a + D_i) \cdot \pi \cdot D_i} = \frac{A_a}{\pi \cdot D_i} = \frac{A_a'}{\pi \cdot D_i}. \tag{20}$$

Taking into consideration equations (3) and (8) this then gives $$d = \frac{(2 \cdot a + D_i)^2 - D_i^2}{4 \cdot D_i}. \quad (21)$$

Since $A_a = A_a' = A_c = A_c'$ equation (21) can also be written as follows by using equation (2):

$$d = \frac{D_a^2 - (D_a - 2 \cdot c)^2}{4 \cdot D_i}. \quad (22)$$

In the embodiments in which the laminate stack or magnet core comprises openings as leadthroughs for incoming and outgoing electrical lines, this can affect flux conduct. This may in turn cause deviations from equations (14) and (17)-(22).

The invention having been thus described with reference to certain specific embodiments and examples thereof, it will be understood that this is illustrative, and not limiting, of the appended claims.

The invention claimed is:

1. A laminate stack comprising:

individual involutely curved soft magnetic sheets each individual sheet comprising:

a first long side, a second long side opposite the first long side, a first short side, and a second short side opposite the first short side, wherein the first long side comprises a recess, wherein when the individual sheet is in an uncurved state, said recess is rectangular and comprises edges that are equidistant from the first short side, the second short side and the second long side respectively;

an inner section, having:

an inside radius $D_i$, and a front face having a surface $A_a$, and a base having a thickness d, an outer section having an outside radius $D_a$ and a thickness c where $$d = \frac{A_a}{\pi \cdot D_i} \text{ or}$$

$$d = \frac{(2 \cdot a + D_i)^2 - D_i^2}{4 \cdot D_i} \text{ or}$$

$$d = \frac{D_a^2 - (D_a - 2 \cdot c)^2}{4 \cdot D_i}.$$

2. The laminate stack in accordance with claim 1, wherein when each individual sheet is in its curved state, it is essentially U-shaped, comprising:

a first leg having a width e, a second leg having a width g, and a base having a thickness d, wherein e=g=d.

3. The laminate stack in accordance with claim 1, wherein the individual sheets are of identical thicknesses.

4. The laminate stack in accordance with claim 1, the individual sheets are of different thicknesses, each individual sheet having a constant thickness.

5. The laminate stack in accordance with claim 1, wherein the first long side and the second long side have a curve which, when represented as parameters in Cartesian x and y coordinates is described by the parametric equation $$\begin{pmatrix} x \\ y \end{pmatrix} = \begin{pmatrix} r \cdot \cos t^* + r \cdot t^* \cdot \sin t^* \\ r \cdot \sin t^* - r \cdot t^* \cdot \cos t^* \end{pmatrix}$$

wherein t* is the parameter, and r is an inside radius of the laminate stack.

6. The laminate stack in accordance with claim 5, wherein the relationship $t^* < \pi$ applies for the parameter t*.

7. The laminate stack in accordance with claim 1, wherein the laminate stack is essentially cylinder-shaped and further comprises at least one annular recess arranged concentrically in the laminate stack and being formed essentially by the recesses of the individual sheets.

8. The laminate stack in accordance with claim 1, wherein the individual sheets comprise an alloy that consists essentially of;

12.0 percent by weight ≤Co≤22.0 percent by weight, 1.5 percent by weight ≤Cr≤4.0 percent by weight, 0.4 percent by weight ≤Mo≤1.2 percent by weight, 0.1 percent by weight ≤V≤0.4 percent by weight, 0.05 percent by weight ≤Si≤0.15 percent by weight, and the remainder Fe.

9. The laminate stack in accordance with claim 8, wherein the individual sheets comprise an alloy that consists essentially of 17.0 percent by weight Co, 2.2 percent by weight Cr, 0.8 percent by weight Mo, 0.2 percent by weight V, 0.09 percent by weight Si and the remainder Fe.

10. The laminate stack in accordance with claim 1, wherein the individual sheets comprise an alloy that consists essentially of:

12.0 percent by weight ≤Co≤22.0 percent by weight, 1.5 percent by weight ≤Cr≤4.0 percent by weight, 1.0 percent by weight ≤Mn≤1.8 percent by weight, 0.4 percent by weight ≤Si≤1.2 percent by weight, 0.1 percent by weight ≤Al≤10.4 percent by weight, and the remainder Fe.

11. The laminate stack in accordance with claim 10, wherein the individual sheets comprise an alloy that consists essentially of 18.0 percent by weight Co, 2.6 percent by weight Cr, 1.4 percent by weight Mn, 0.8 percent by weight Si, 0.2 percent by weight Al and the remainder Fe.

12. The laminate stack in accordance with claim 1, wherein the individual sheets comprise an alloy that consists essentially of:

12.0 percent by weight ≤Co≤22.0 percent by weight, 1.0 percent by weight ≤Cr≤2.0 percent by weight, 0.5 percent by weight ≤Mn≤1.5 percent by weight, 0.6 percent by weight ≤Si≤1.8 percent by weight, 0.1 percent by weight ≤V≤0.2 percent by weight, and the remainder Fe.

13. The laminate stack in accordance with claim 12, wherein the individual sheets comprise an alloy that consists essentially of 17.0 percent by weight Co, 1.4 percent by weight Cr, 1.0 percent by weight Mn, 1.2 percent by weight Si, 0.13 percent by weight V and the remainder Fe.

14. The laminate stack in accordance with claim 1, wherein the individual sheets comprise an alloy that consists essentially of:

15 percent by weight ≤Co≤18.0 percent by weight, 0 percent by weight ≤Mn≤3.5 percent by weight, 0 percent by weight ≤Si≤1.8 percent by weight, and the remainder Fe.

15. The laminate stack in accordance with claim 14, wherein the individual sheets comprise an alloy that consists essentially of 15 percent by weight ≤Co≤18.0 percent by weight and the remainder Fe.

16. The laminate stack in accordance with claim 14, wherein the individual sheets comprise an alloy that consists essentially of 15 percent by weight ≤Co, 1 percent by weight Si and the remainder Fe.

17. The laminate stack in accordance with claim 14, wherein the individual sheets comprise an alloy that consists essentially of 15 percent by weight ≤Co, 2.7 percent by weight Mn and the remainder Fe.

18. The laminate stack in accordance with claim 1, wherein the individual sheets comprise an alloy that consists essentially of:

0 percent by weight <Ni<5.0 percent by weight,
0 percent by weight <Co<1.0 percent by weight,
0 percent by weight <C<0.03 percent by weight,
0 percent by weight <Si<0.5 percent by weight,
0 percent by weight <S<0.03 percent by weight,
0 percent by weight <Al<0.08 percent by weight,
0 percent by weight <Ti<0.1 percent by weight,
0 percent by weight <V<0.1 percent by weight,
0 percent by weight <P<0.015 percent by weight,
0.03 percent by weight <Mn<0.2 percent by weight, and the remainder Fe.

19. The laminate stack in accordance with claim 1, wherein the individual sheets comprise an alloy that v consists essentially of;

0 percent by weight <Ni<5.0 percent by weight,
0 percent by weight <Co<1.0 percent by weight,
0 percent by weight <C<0.1 percent by weight,
0 percent by weight <Si<4.5 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight, and the remainder Fe.

20. The laminate stack in accordance with claim 1, wherein the individual sheets comprise an alloy that consists essentially of:

5 percent by weight <Cr<23.0 percent by weight,
0 percent by weight <Ni<8.0 percent by weight,
0 percent by weight <Co<1.0 percent by weight,
0 percent by weight <C<0.1 percent by weight,
0 percent by weight <Si<4.0 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight, and the remainder Fe.

21. The laminate stack in accordance with claim 1, wherein the individual sheets comprise an alloy that consists essentially of:

20 percent by weight <Ni<85.0 percent by weight,
0 percent by weight <Co<1.0 percent by weight,
0 percent by weight <C<0.1 percent by weight,
0 percent by weight <Si<4.0 percent by weight,
0 percent by weight <S<0.1 percent by weight,
0 percent by weight <Al<2.0 percent by weight,
0 percent by weight <Mo<5.0 percent by weight,
0 percent by weight <Mn<4.0 percent by weight,
0 percent by weight <Cu<5.0 percent by weight, and the remainder Fe.

22. The laminate stack in accordance with claim 1, wherein the individual sheets comprise an alloy that consists the composition in percent by weight of $Fe_{rem}Co_aCr_bS_cMo_dSi_eAl_fMn_gM_hV_iNi_jC_kCu_lP_mN_nO_oB_p$ with 0%≤a≤50%, 0%≤b≤20%, 0%≤c≤0.5%, 0%≤d≤3%, 0%≤e≤3.5%, 0%≤f≤4.5%, 0%≤g≤4.5%, 0% h≤6%, 0%≤i≤4.5%, 0%≤j≤5%, 0%≤k<0.05%, 0%≤l<1%, 0%≤m<0.1%, 0%≤n<0.5%, 0%≤o<0.05%, 0%≤p <0.01%, where M is at least one of the elements Sn, Zn, W, Ta, Nb, Zr and Ti.

23. The laminate stack in accordance with claim 22, wherein the individual sheets comprise an alloy that consists essentially has the composition in percent by weight $Fe_{rem}Co_{17}Cr_2$.

24. The laminate stack in accordance with 22, wherein the individual sheets comprise an alloy that consists essentially has the composition in percent by weight $Fe_{rem}Co_a$ with 3≤a≤25.

25. The laminate stack in accordance with claim 1, wherein the individual sheets comprise silicated electroplates.

26. The laminate stack in accordance with claim 1, wherein the individual sheets comprise pure iron.

27. The laminate stack in accordance with claim 1, wherein the individual sheets comprise of a chrome steel.

28. The laminate stack in accordance with claim 1, wherein the individual sheets further comprise at least one electrically insulating coating on at least one side.

29. The laminate stack in accordance with claim 28, wherein the electrically insulating coating comprises magnesium oxide (MgO).

30. The laminate stack in accordance with claim 28, wherein the electrically insulating coating comprises zirconium oxide ($ZrO_2$).

31. The laminate stack in accordance with claim 28, wherein the electrically insulating coating comprises magnetite ($Fe_3O_4$).

32. The laminate stack in accordance with claim 28, wherein the electrically insulating coating comprises haematite ($Fe_2O_3$).

33. The laminate stack in accordance with claim 28, wherein the electrically insulating coating comprises a self-oxidising layer.

34. The laminate stack in accordance with claim 1, further comprising at least one opening, said at least one opening forming a leadthrough.

35. An electromagnetic actuator comprising a soft magnetic core, the soft magnetic core comprising at least one laminate stack in accordance with claim 1.

36. The electromagnetic actuator in accordance with claim 35, wherein the electromagnetic actuator is an inlet/outlet valve.

37. The electromagnetic actuator in accordance with claim 35, wherein the electromagnetic actuator is an injection valve for controlling a quantity of fuel to be fed into an internal combustion engine.

38. The electromagnetic actuator in accordance with claim 37, wherein the injection valve comprises;

a valve body;
a valve seat toward and away from which the valve body can move;
an electromagnetic coil system adapted to more the valve body toward and away from the valve seat and comprising at least one coil and a soft magnetic core; and
a soft magnetic magnet armature connected to the valve body.

39. The electromagnetic actuator in accordance with claim 38, wherein the soft magnetic core, or soft magnetic magnet armature, or both, is arranged concentrically to a central axis of the injection valve.

40. The electromagnetic actuator in accordance with claim 38, wherein the soft magnetic core and the soft magnetic magnet armature are arranged concentrically to a central axis of the injection valve.

41. The electromagnetic actuator in accordance with claim 37, further comprising a spring element that biases the valve body connected to the magnet armature into an open position or into a closed position of the injection valve, and wherein the valve body can be moved into the closed position or into the open position by passing a current through the electromagnetic coil system.

42. The electromagnetic actuator in accordance with claim 37, wherein the soft magnetic core is essentially cylindrical and comprises at least one annular recess for receiving the coil, the annular recess being arranged concentrically in the soft magnetic core, and the annular recess being formed essentially by the recesses in the individual sheets in the laminate stack of the soft magnetic core.

43. A process for the manufacture of a laminate stack according to claim 1 comprising:

forming of individual soft magnetic sheets, each individual sheet comprising:

a first long side, a second long side opposite the first long side, a first short side, and a second short side opposite the first short side, wherein the first long side comprises a recess, said recess being rectangular and defined by edges, each of which are equidistant from the first short side, the second short side, and the second long side, respectively when the individual soft magnetic sheet is in its uncurved state, curving of the individual soft magnetic sheets into an involute shape, to form curved individual soft magnetic sheets, stacking of the curved individual soft magnetic sheets to form a laminate stack.

44. The process in accordance with claim 43, wherein the individual soft magnetic sheets are formed with the same thickness.

45. The process in accordance with claim 43, wherein the individual soft magnetic sheets are formed in such a manner that the individual soft magnetic sheets are of different thicknesses, each individual soft magnetic sheet being of constant thickness.

46. The process in accordance with claim 43, further comprising forming an electrically insulating coating on one or more individual soft magnetic sheets before or after the stacking of the individual soft magnetic sheets to form the laminate stack.

47. The process in accordance with claim 46, wherein forming the coating comprises spraying.

48. The process in accordance with claim 46, wherein forming the coating comprises dipping.

49. The process in accordance with claim 46, wherein forming the coating comprises oxidation in air.

50. The process in accordance with claim 46, wherein forming the coating comprises oxidation in steam.

51. The process in accordance with claim 43, wherein forming the individual sheets comprises stamping.

52. The process in accordance with claim 43, wherein forming the individual sheets comprises wire eroding.

53. The process in accordance with claim 43, wherein forming the individual sheets comprising cutting.

54. The process in accordance with claim 43, wherein the individual sheets comprise an alloy that consists essentially of:

12.0 percent by weight ≤Co≤22.0 percent by weight, 1.5 percent by weight ≤Cr≤4.0 percent by weight, 0.4 percent by weight ≤Mo≤1.2 percent by weight, 0.1 percent by weight ≤V≤0.4 percent by weight, 0.05 percent by weight ≤Si≤0.15 percent by weight and the remainder Fe.

55. The process in accordance with claim 54, wherein the individual sheets comprise an alloy that consists essentially of 17.0 percent by weight Co, 2.2 percent by weight Cr, 0.8 percent by weight Mo, 0.2 percent by weight V, 0.09 percent by weight Si and the remainder Fe.

56. The process in accordance with claim 43, wherein the individual sheets comprise an alloy that consists essentially of:

12.0 percent by weight ≤Co≤22.0 percent by weight, 1.5 percent by weight ≤Cr≤4.0 percent by weight, 1.0 percent by weight ≤Mn≤1.8 percent by weight, 0.4 percent by weight ≤Si≤1.2 percent by weight, 0.1 percent by weight ≤Al≤0.4 percent by weight, and the remainder Fe.

57. The process in accordance with claim 56, wherein the individual sheets comprise an alloy that consists essentially of 18.0 percent by weight Co, 2.6 percent by weight Cr, 1.4 percent by weight Mn, 0.8 percent by weight Si, 0.2 percent by weight Al and the remainder Fe.

58. The process in accordance with claim 43, wherein the individual sheets comprise an alloy that consists essentially of 12.0 percent by weight ≤Co≤22.0 percent by weight, 1.0 percent by weight ≤Cr≤2.0 percent by weight, 0.5 percent by weight ≤Mn≤1.5 percent by weight, 0.6 percent by weight ≤Si≤1.8 percent by weight, 0.1 percent by weight ≤V≤0.2 percent by weight, and the remainder Fe.

59. The process in accordance with claim 58, wherein the individual sheets comprise an alloy that consists essentially of 17.0 percent by weight Co, 1.4 percent by weight Cr, 1.0 percent by weight Mn, 1.2 percent by weight Si, 0.13 percent by weight V and the remainder Fe.

60. The process in accordance with claim 43, wherein the individual sheets comprise an alloy that consists essentially of:

15 percent by weight ≤Co≤18.0 percent by weight, 0 percent by weight ≤Mn≤3.5 percent by weight, 0 percent by weight ≤Si≤1.8 percent by weight, and the remainder Fe.

61. The process in accordance with claim 60, wherein the individual sheets comprise an alloy that consists essentially of 15 percent by weight ≤Co≤18.0 percent by weight and the remainder Fe.

62. The process in accordance with claim 60, wherein the individual sheets comprise an alloy that consists essentially of 15 percent by weight ≤Co, 1 percent by weight Si and the remainder Fe.

63. The process in accordance with claim 60, wherein the individual sheets comprise an alloy that consists essentially of 15 percent by weight ≤Co, 2.7 percent by weight Mn and the remainder Fe.

64. The process in accordance with claim 43, wherein the individual sheets comprise an alloy that consists essentially of:

0 percent by weight <Ni<5.0 percent by weight, 0 percent by weight <Co≤1.0 percent by weight, 0 percent by weight <C<0.03 percent by weight, 0 percent by weight <Si<0.5 percent by weight, 0 percent by weight <S<0.03 percent by weight, 0 percent by weight <Al<0.08 percent by weight, 0 percent by weight <Ti<0.1 percent by weight, 0 percent by weight <V≤0.1 percent by weight,
0 percent by weight <P≤0.015 percent by weight,
0.03 percent by weight <Mn<0.2 percent by weight, and the remainder Fe.

65. The process in accordance with claim 43, wherein the individual sheets comprise an alloy that consists essentially of:

0 percent by weight <Ni<5.0 percent by weight,
0 percent by weight <Co<1.0 percent by weight,
0 percent by weight <C<0.1 percent by weight,
0 percent by weight <Si<4.5 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight, and the remainder Fe.

66. The process in accordance with claim 43, wherein the individual sheets comprise an alloy that consists essentially of:

5 percent by weight <Cr<23.0 percent by weight,
0 percent by weight <Ni<8.0 percent by weight,
0 percent by weight <Co<1.0 percent by weight,
0 percent by weight <C<0.1 percent by weight,
0 percent by weight <Si<4.0 percent by weight,
0 percent by weight <S<1.0 percent by weight,
0 percent by weight <Al<2.0 percent by weight,
0 percent by weight <Mo<1.0 percent by weight,
0 percent by weight <Mn<1.0 percent by weight, and the remainder Fe.

67. The process in accordance with claim 43, wherein the individual sheets comprise an alloy that consists essentially of:

20 percent by weight <Ni<85.0 percent by weight,
0 percent by weight <Co<1.0 percent by weight,
0 percent by weight <C<0.1 percent by weight,
0 percent by weight <Si<4.0 percent by weight,
0 percent by weight <S<0.1 percent by weight,
0 percent by weight <Al<2.0 percent by weight,
0 percent by weight <Mo<5.0 percent by weight,
0 percent by weight <Mn<4.0 percent by weight,
0 percent by weight <Cu<5.0 percent by weight, and the remainder Fe.

68. The process in accordance with claim 43, wherein the individual sheets comprise an alloy that has the composition in percent by weight of $Fe_{res}Co_aCr_bSi_cMo_dSi_eAl_fMn_gM_h$-$V_iNi_jC_kCu_lP_mN_nO_oB_p$ with 0%≤a≤50%, 0%≤b≤20%, 0%≤c≤0.5%, 0%≤d≤3%, 0%≤e≤3.5%, 0%≤f≤4.5%, 0%≤g≤4.5%, 0%≤h≤6%, 0%≤i≤4.5%, 0%≤j≤5%, 0%≤k<0.05%, 0%≤l<1%, 0%≤m<0.1%, 0%≤n<0.5%, 0%≤o<0.05% and 0%≤p<0.01%, where M is at least one of the elements Sn, Zn, W, Ta, Mb, Zr and Ti.

69. The process in accordance with claim 68, wherein the individual sheets comprise an alloy that essentially has the composition in percent by weight $Fe_{rem}Co_{17}Cr_2$.

70. The process in accordance with claim 68, wherein the individual sheets comprise an alloy that essentially has the composition in percent by weight $Fe_{rem}Co_a$ with 3≤a≤2.5.

71. The process in accordance with claim 43, wherein the individual sheets comprise silicated electroplates.

72. The process in accordance with claim 43, wherein the individual sheets comprise pure iron.

73. The process in accordance claim 43, wherein the individual sheets comprise a chrome steel.

74. The process in accordance with claim 43, wherein the laminate stack further comprises at least one opening, said at least one opening forming a leadthrough.

75. A process for the manufacture of an electromagnetic actuator, comprising:

forming a laminate stack in accordance with claim 43, and
forming a soft magnetic core for the electromagnetic actuator from the laminate stack.

76. A process for the manufacture of an injection valve for controlling a quantity of fuel to be fed into an internal combustion engine comprising:

forming a laminate stack in accordance with claim 43, and
forming of a soft magnetic core for an electromagnetic coil system of the injection valve from the laminate stack.

* * * * *

UNITED STATES PATENT AND TRADEMARK OFFICE

CERTIFICATE OF CORRECTION

PATENT NO. : 8,669,837 B2
APPLICATION NO. : 12/869243
DATED : March 11, 2014
INVENTOR(S) : Gerster et al.

It is certified that error appears in the above-identified patent and that said Letters Patent is hereby corrected as shown below:

In the Specification

Column 4, line 5 delete "0,1 percent by weight ≤ A ≤ 0.4 percent by weight" and replace therewith -- 0,1 percent by weight ≤ Al ≤ 0.4 percent by weight --.

Column 4, line 13 delete "0,5 percent by weight ≤ MN ≤ ≤ 1.5 percent by weight" and replace therewith -- 0,5 percent by weight ≤ Mn ≤ 1.5 percent by weight --.

Column 5, line 20 delete "0% ≤ l ≤ 1%, 0% ≤ m < 0.1% ≤ n < 0.5%, 0%≤ o < 0.05%" and replace therewith -- 0% ≤ l ≤ 1%, 0% ≤ m < 0.1%, 0% ≤ n < 0.5%, 0% ≤ o < 0.05% --.

Column 7, line 57 delete "0,1 percent by weight ≤ A ≤ 10.4 percent by weight" and replace therewith -- 0,1 percent by weight ≤ Al ≤ 0.4 percent by weight --.

Column 9, line 7 delete "0% ≤ l ≤ 1%, 0% ≤ m < 0.1% ≤ n < 0.5%, 0% ≤ o < 0.05%"" and replace therewith -- 0% ≤ l ≤ 1%, 0% ≤ m < 0.1%, 0% ≤ n < 0.5%, 0% ≤ o < 0.05% --.

In the Claims

Claim 10, line 38 delete "0,1 percent by weight ≤ Al ≤ 10.4 percent by weight, and the remainder Fe." and replace therewith -- 0,1 percent by weight ≤ Al ≤ 0.4 percent by weight, and the remainder Fe.--.

Signed and Sealed this
Seventh Day of October, 2014

Michelle K. Lee

Michelle K. Lee
*Deputy Director of the United States Patent and Trademark Office*